United States Patent [19]

Lipski

[11] Patent Number: 4,656,678

[45] Date of Patent: Apr. 14, 1987

[54] BATH TUB STOOL

[76] Inventor: Mordechai Lipski, 12 Recanati Street, Tel Aviv, Israel

[21] Appl. No.: 784,805

[22] Filed: Oct. 4, 1985

[30] Foreign Application Priority Data

Jul. 21, 1985 [IL] Israel ..... 75860

[51] Int. Cl.[4] ..... A47K 3/022; A47K 3/12

[52] U.S. Cl. ..... 4/578; 4/485; 4/579; 4/559; 4/571; 297/165

[58] Field of Search ..... 4/484, 578, 451, 579, 4/452, 599, 460, 584, 461, 462, 485; 248/165, 166; 297/108, 111, 153, 165

[56] References Cited

U.S. PATENT DOCUMENTS

| | | | |
|---|---|---|---|
| 1,428,039 | 9/1922 | Kratz | 4/579 X |
| 1,563,236 | 11/1925 | Smith | 4/460 X |
| 2,459,601 | 1/1949 | Tiritilli | 4/484 |
| 2,801,426 | 8/1957 | La Gorce et al. | 4/484 |
| 2,813,576 | 11/1957 | Mayer | 248/165 |
| 3,232,584 | 2/1966 | Miles | 248/166 |
| 3,290,090 | 12/1966 | Ford | 4/578 |
| 3,391,409 | 7/1968 | Gatley | 4/599 |
| 3,950,794 | 4/1976 | Dalton | 4/484 |
| 3,970,278 | 7/1976 | Studer | 248/165 X |
| 4,453,280 | 6/1984 | Greenleaf | 4/599 |

*Primary Examiner*—Henry K. Artis
*Attorney, Agent, or Firm*—Toren, McGeady and Goldberg

[57] ABSTRACT

There is provided a stool which can be placed in a bath tub. It is intended for use by invalids and otherwise handicapped or elderly persons. It comprises a seat with detachably or foldably connected legs. The seat has an extension or extensions on to which soap and other requisites can be placed.

7 Claims, 3 Drawing Figures

BATH TUB STOOL

FIELD AND BACKGROUND OF INVENTION

The present invention relates to a bath tub stool which is mainly but not exclusively intended for use of invalids and elderly people.

It is well known that handicapped persons, invalids, elderly people and the like have difficulties in taking a bath or even having a shower. This is due to many reasons and conditions, which may be founded in the physical condition of the person and/or the local conditions of the respective bathing equipment. It is especially problematic for such persons to lie down in the bath tub, since they have difficulty in getting up.

OBJECT OF INVENTION

It is the object of the invention to provide means which will aid and ease the handicapped and to facilitate their having a shower or a bath.

SHORT SUMMARY OF DISCLOSURE

According to the invention the new device comprises a perforated seat with detachable or hinged legs connected thereto and means for stabilizing said legs in a set up position of the seat, means being further provided for carrying soap, sponge or the like.

DETAILED DESCRIPTION OF PREFERRED EMBODIMENT

These and further features of the new bath tub seat will become clear from the following detailed description which refers to the annexed drawings in which.

Figure 1:
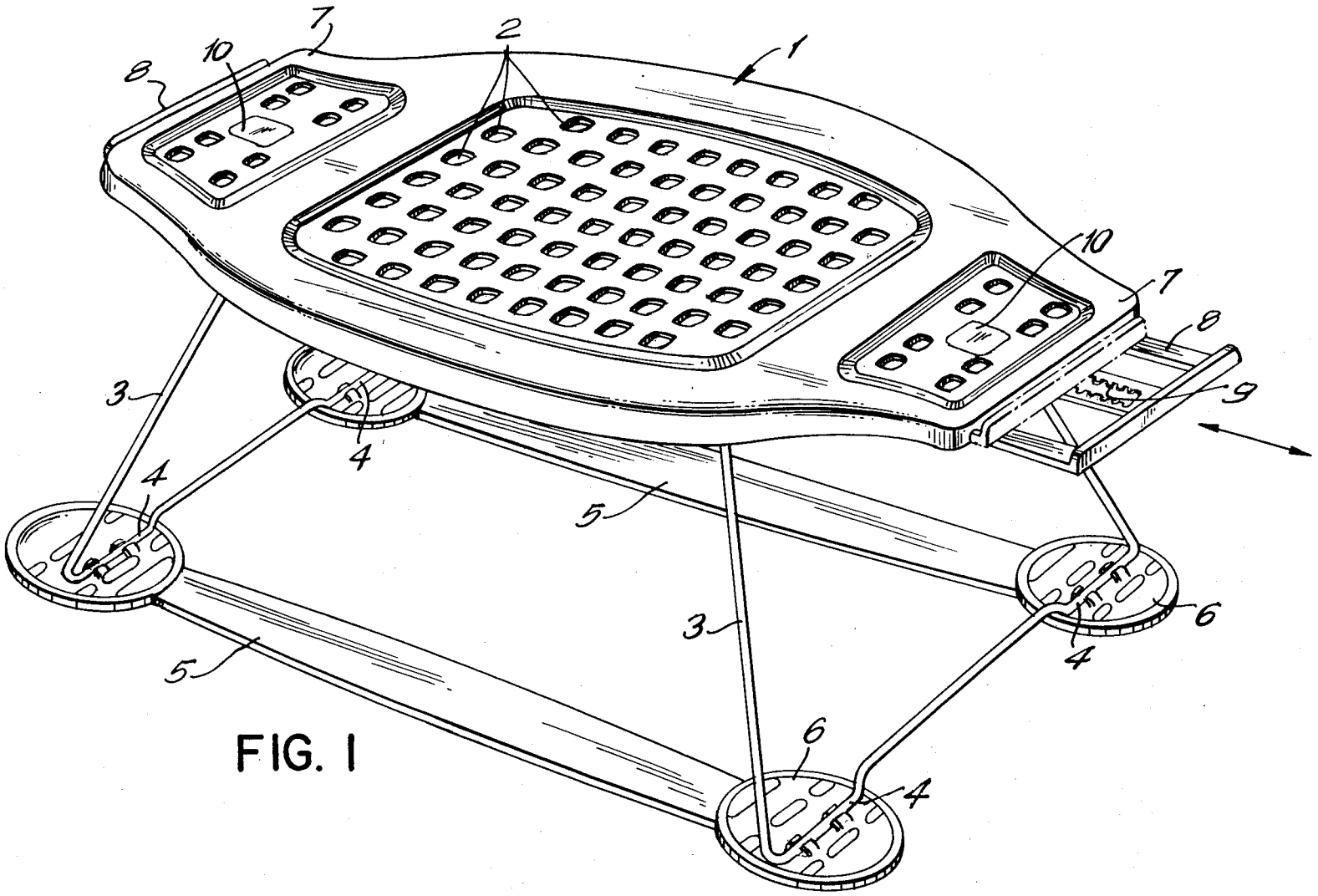
FIG. 1 is a perspective view of the new seat.

Turning first to FIG. 1 the new stool comprises a seat 1 with a plurality of openings 2. To the underside of seat 1 are detachably connected two U-shaped hoops serving as legs 3. These U-shaped legs are preferably made of strong wire. At the lower ends of the legs the horizontal webs of the U comprise two set off portions 4 which can be snap engaged by claps provided at the end pieces 6 of flat bars 5 thereby stabilizing the legs and preventing them from folding onto the seat which would result in the collapse of the seat. The said end pieces may have a roughened underside, such as to prevent sliding of the seat on the bottom of the bath tub and to allow the free flow of water.

Figure 2:
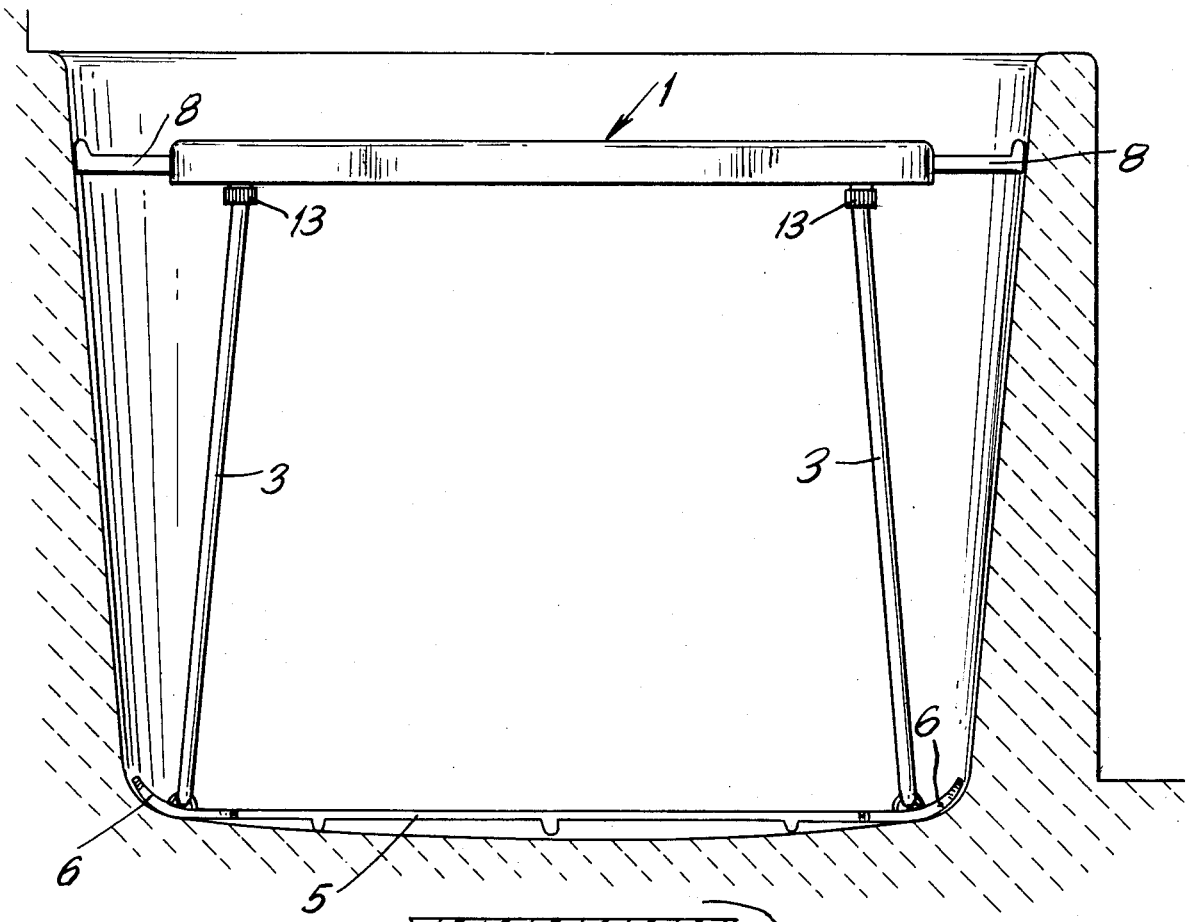
FIG. 2 is an elevation section of the seat in a set up condition placed in a bath tub.

As can be seen the two sides of the seat are extended to form two tray like portions 7. These tray like portions 7 are designed for placing thereon soap, sponge and the like things used while having a bath or taking a shower. Beneath the end portions 7 of the seat are slidingly positioned stabilizers 8 which comprise a central slot 9 the longitudinal edges of which are serrated, when pulled out, the stabilizers are immobilized by means of a plug 10, which is pushed inwardly and engages in the slot 9, being held by the serrations. The stabilizers are set to lean onto the sides of the tub (see FIG. 2) thus preventing the stool from slipping or sliding.

Figure 3:
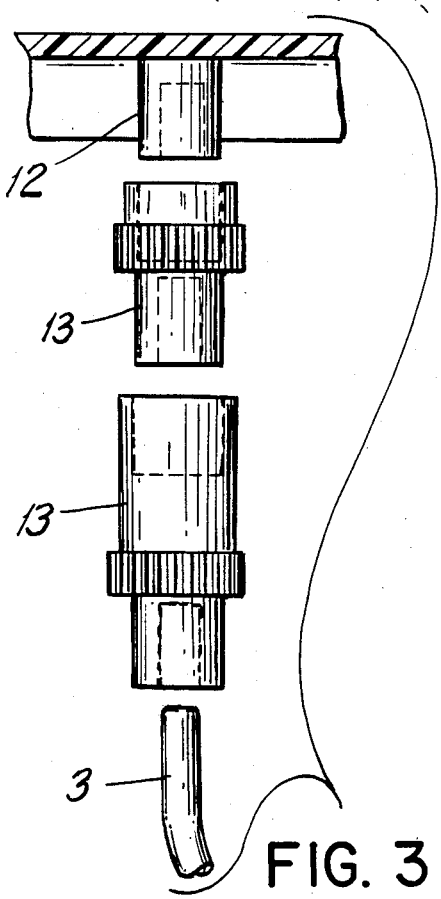
FIG. 3 illustrates constructional details.

Since the stool might have to serve in a higher or lower position, the hoops forming the legs may be distinct from the seat which latter may have a downwardly extending boss 12 (see FIG. 3) and inserts 13 fitting onto boss 12 at their top and onto the top of the legs 3 at their lower ends may be provided to increase the height of the stool. When not in use, the stool can be folded and put aside without occupying any space.

I claim:

1. A bath tub stool comprising a perforated seat and a pair of U-shaped hoops connected to the seat serving as legs movable relative to the seat, wherein the seat has at least one lateral extension onto which washing requisites, such as soap, a sponge and the like can be deposited, a pair of elongated lower stabilizing strips each having at both its ends gripping means which are adapted to grip the web portion of the U-shaped hoops, whereby the two hoops are spread apart and the collapse of support of the stool and comprising at least one upper stabilizer which is positioned beneath the lateral extension of the seat, the at least one upper stabilizer designed to lean onto the side of the tub, so as to prevent the slipping or sliding of the stool is prevented.

2. The bath tub stool claimed in claim 1, wherein the legs are hinged to the seat.

3. The bath tub stool claimed in claim 1, wherein downwardly extending bosses are provided at the underside of the seat, and the free ends of the hoops are hollow and can be press fitted onto said bosses.

4. The bath tub stool claimed in claim 3, comprising insert pieces having both ends hollowed and configured to be interpositioned between the bosses and the free ends of the hoops.

5. The stool claimed in claim 1, comprising means for immobilizing the stabilizer when these are slid outwardly from the position below the lateral extensions of the seat.

6. A bath tub stool comprising a seat, a pair of U-shaped hoops having web portions, the free ends of the hoops hinged to the seat, a pair of elongated lower stabilizing strip members each having top and bottom sides, grip means on the top side engaging the web portions of the loop to stabilize the legs and prevent collapse of the seat, the seat having a pair of laterally projecting portions, an upper stabilizing member slidably attached to each projecting portion, the stabilizing members having outwardly facing edges adapted to contact the side walls of a bath tub, and means for arresting the stabilizing members in a desired position.

7. The bath tub stool claimed in claim 6, wherein the bottom sides of the strips are roughened to prevent slipping of the stool.

* * * * *